US007989744B2

(12) United States Patent
Facciano et al.

(10) Patent No.: US 7,989,744 B2
(45) Date of Patent: Aug. 2, 2011

(54) METHODS AND APPARATUS FOR TRANSFERRING A FLUID

(75) Inventors: Andrew B. Facciano, Oro Valley, AZ (US); Robert T. Moore, Tucson, AZ (US); Gregg J. Hlavacek, Tucson, AZ (US); Michael D. Do, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 476 days.

(21) Appl. No.: 12/024,532

(22) Filed: Feb. 1, 2008

(65) Prior Publication Data

US 2009/0194632 A1 Aug. 6, 2009

(51) Int. Cl.
*B64G 1/24* (2006.01)
*F42B 15/01* (2006.01)
*F42B 15/00* (2006.01)

(52) U.S. Cl. ..... 244/3.22; 244/3.1; 244/3.15; 244/3.21; 244/158.1; 244/164; 244/169

(58) Field of Classification Search ..... 244/3.1–3.3, 244/169, 158.1, 164; 60/200.1, 204, 205, 60/207, 224–226.3, 257–260
See application file for complete search history.

(56) References Cited

U.S. PATENT DOCUMENTS 2,726,510 A * 12/1955 Goddard ..... 60/224
3,197,959 A * 8/1965 Keller ..... 60/224
3,249,325 A * 5/1966 Forehand ..... 244/3.22
3,350,886 A * 11/1967 Ferand et al. ..... 60/225
3,446,023 A * 5/1969 Mosier ..... 60/257
3,502,285 A * 3/1970 Gambill ..... 244/3.22
3,788,069 A * 1/1974 Schmidt ..... 60/207
3,802,190 A * 4/1974 Kaufmann ..... 60/225
4,211,378 A * 7/1980 Crepin ..... 244/3.22
5,062,593 A * 11/1991 Goddard et al. ..... 244/169
5,072,891 A * 12/1991 Cavalleri et al. ..... 244/3.21
5,125,596 A * 6/1992 Cavalleri ..... 244/3.22
5,456,425 A * 10/1995 Morris et al. ..... 244/3.22
6,267,326 B1 * 7/2001 Smith et al. ..... 244/3.22

OTHER PUBLICATIONS

A. Parsch, "U.S. Military Rockets and Missiles"; entry entitled, "CGM/HGM-16"; posted on the Internet at designation-systems.net; not dated; last updated Aug. 26, 2005.*

Webpage on "Rocket R-7" on the Internet at energia.ru; no author given; no date given; accessed on Aug. 14, 2010.*

Webpage entitled, "R-7-SS-6 SAPWOOD" on the Internet at fas.org; last updated Jul. 29, 2000; no author given.*

* cited by examiner

*Primary Examiner* — Bernarr E Gregory

(74) *Attorney, Agent, or Firm* — Ingrassia Fisher & Lorenz, P.C.

(57) ABSTRACT

Methods and apparatus for a missile having an external system operate in conjunction with an airframe and a fluid transfer system. The airframe includes an interior surface defining a substantially enclosed internal chamber. The fluid transfer system selectively connects the internal chamber to the external system, for example to provide pressurant or coolant to the external system.

21 Claims, 8 Drawing Sheets

METHODS AND APPARATUS FOR TRANSFERRING A FLUID

BACKGROUND OF INVENTION

Many applications require a tank to contain a pressurized fluid. For instance many projectiles contain one or more tanks for fuel, oxidizer, and pressurant, among other things. The tank is often pressurized, and is often mechanically attached to the airframe of the projectile. Sometimes the tank is coupled to other tanks using tubes and mounts. For instance in one embodiment one tank containing a pressurant is mechanically attached to the inside of the airframe while separate tanks containing fuel and oxidizer are mounted to the outside of the airframe and coupled to the pressurant tank using tubes. In this embodiment the pressurant is used to collapse thin metallic bladders within the fuel and oxidizer tanks in order to expel and utilize all of the fuel and oxidizer.

The tank is usually very thick in order to prevent leaks and at the same time provide stiffness and rigidity to the projectile structure. In addition the tank often contains a thin metallic liner, often made of aluminum, titanium, or corrosion resistant steel (CRES), to further prevent leakage. Unfortunately the tank and the liner both increase the weight of the projectile, requiring more fuel. For instance for long range projectiles every pound added to the payload can result in ten pounds of fuel added to a first booster stage and five pounds of fuel added to a second booster stage. The problem is compounded because as the weight of the fuel increases, more fuel is needed to carry the weight of the increased fuel. The added weight also degrades the kinematic performance of the projectile.

Some composite pressurant tanks have been developed without a liner, reducing the weight, but this has not been an optimal solution for projectiles that are stored before use because the tank walls may age and degrade, resulting in leaks. For instance, some projectiles such as kill vehicles may be stored for ten to fifteen years before use. The use of toroidal tanks has been proposed to reduce weight, but this solution has not been optimal as toroidal tanks are more cumbersome and thus require additional unwanted changes to the propulsion system layout and assembly. Efforts to rearrange the locations of the tanks could result in a lighter projectile airframe but would also make internal propellant components inaccessible during assembly and servicing. Thus prior art attempts have failed to fully solve this problem. The present invention attempts to solve this problem by combining the tank with the airframe of the projectile.

SUMMARY OF THE INVENTION

Methods and apparatus for a missile having an external system operate in conjunction with an airframe and a fluid transfer system. The airframe includes an interior surface defining a substantially enclosed internal chamber. The fluid transfer system selectively connects the internal chamber to the external system, for example to provide pressurant or coolant to the external system.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF THE INVENTION

Intro

The present invention may be described in terms of functional block components and various processing steps. Such functional blocks may be realized by any number of elements configured to perform the specified functions and achieve the various results. For example, the present invention may be adapted for various fluids, materials, tanks, projectiles and craft, and the like. Thus, the present invention may employ various airframes, propulsion systems, payloads, attitude control systems, guidance systems, integrated circuits, power sources, apparatuses, pipes, tubes, connectors, materials, etc., to perform its functions. The systems described here are merely exemplary applications for the invention.

General

Figure 1:
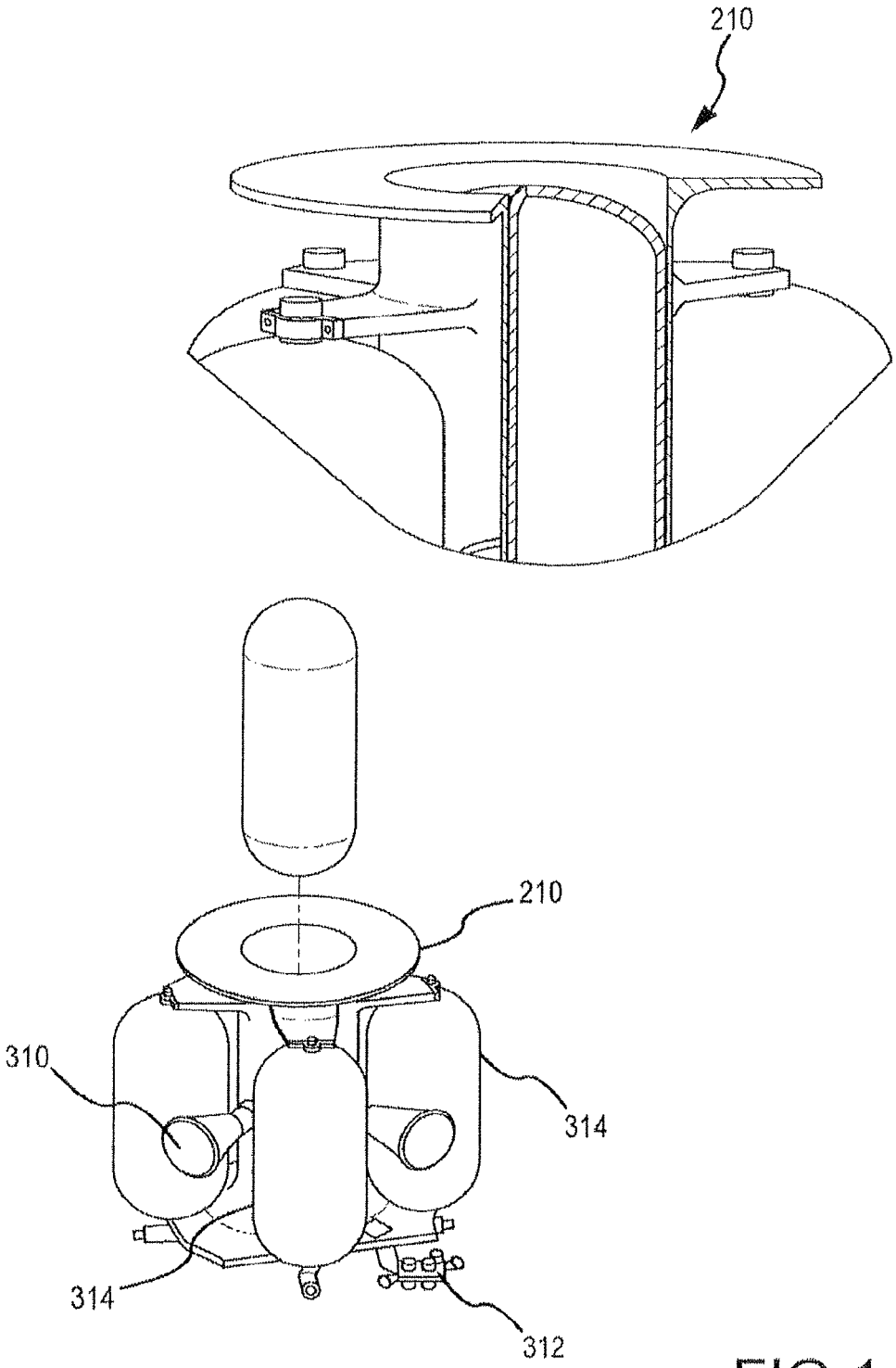
PRIOR ART FIG. 1
FIG. 1 illustrates a prior art system comprising a separate helium tank.
Figure 2:
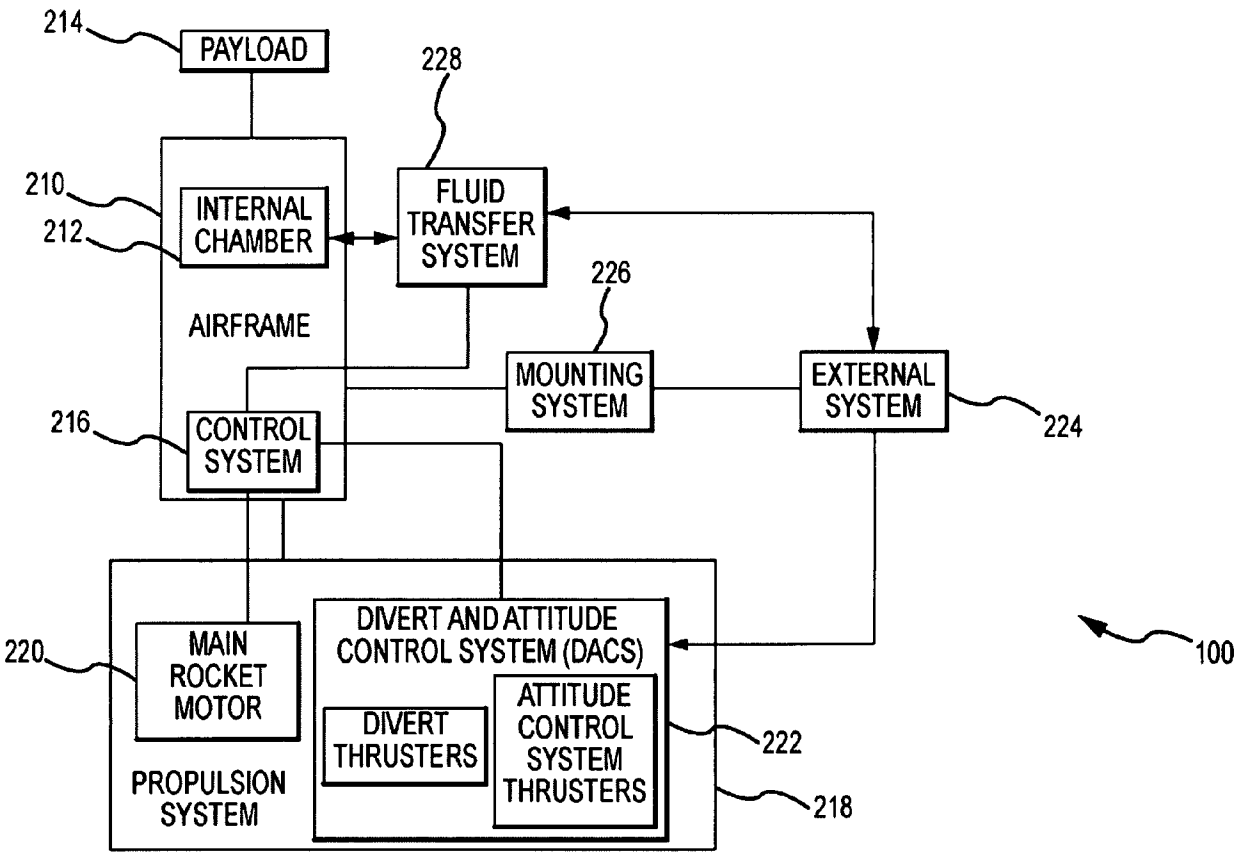
FIG. 2 is a block diagram of a missile having various elements and subsystems.

Prior art systems have used a fluid tank separate from the airframe, as shown in FIG. 1. Methods and apparatus according to various aspects of the present invention operate in conjunction with an airframe comprising an integrated fluid tank. For example, referring now to FIG. 2, a missile 100 according to various aspects of the present invention comprises an airframe 210 having an internal chamber 212, such as an integrated fluid tank, such as to supply pressurizing fluid for a flight control system or coolant for a sensor system. In the present embodiment, the missile 100 comprises a payload 214, a control system 216, and a propulsion system 218.

Payload

The payload 214 comprises an item for delivery by the missile 100 or craft. The payload 214 may comprise any appropriate article or system, such as personnel, cargo, explosives, warhead, mass, and the like. In one embodiment, the missile 100 comprises an exoatmospheric kill vehicle configured to engage high-speed ballistic missile warheads using only force of impact to destroy the target. Thus, the payload of the missile 100 may be the mass of the missile 100 itself.

Control System

The control system 216 controls the flight and operation of the missile 100. The control system 216 may comprise any appropriate elements, such as sensors, processors, communications, and provide any appropriate control functions, such as navigation, propulsion control, flight management, target discrimination, and target tracking. For example, the control system 216 may include optics and sensors for viewing targets and generating target data, as well as supporting hardware and software, cryogenic cooling, power supplies, and other control and support systems. The control system 216 may further comprise a communications link, for example to communicate with a control center, other missiles, and/or other warfighting elements. The control system 216 may further include navigation and guidance systems to control the propulsion system 218 to control the position and attitude of the missile 100.

Propulsion System

The propulsion system 218 provides the propulsion for controlling the position and/or attitude of the missile 100. The propulsion system 218 may comprise any suitable systems for affecting the position and/or attitude of the missile, such as engines, thrusters, motors, jets, rockets, and/or the like. In the present embodiment, the initial velocity is provided by one or more rocket-propelled booster stages (not shown) and/or a main rocket motor 220. In addition, the propulsion system 218 of the present embodiment comprises a lateral and/or attitude control system for control lateral, roll, pitch, and yaw movement of the missile 100.

DACS/Divert Thrusters

Figure 3:
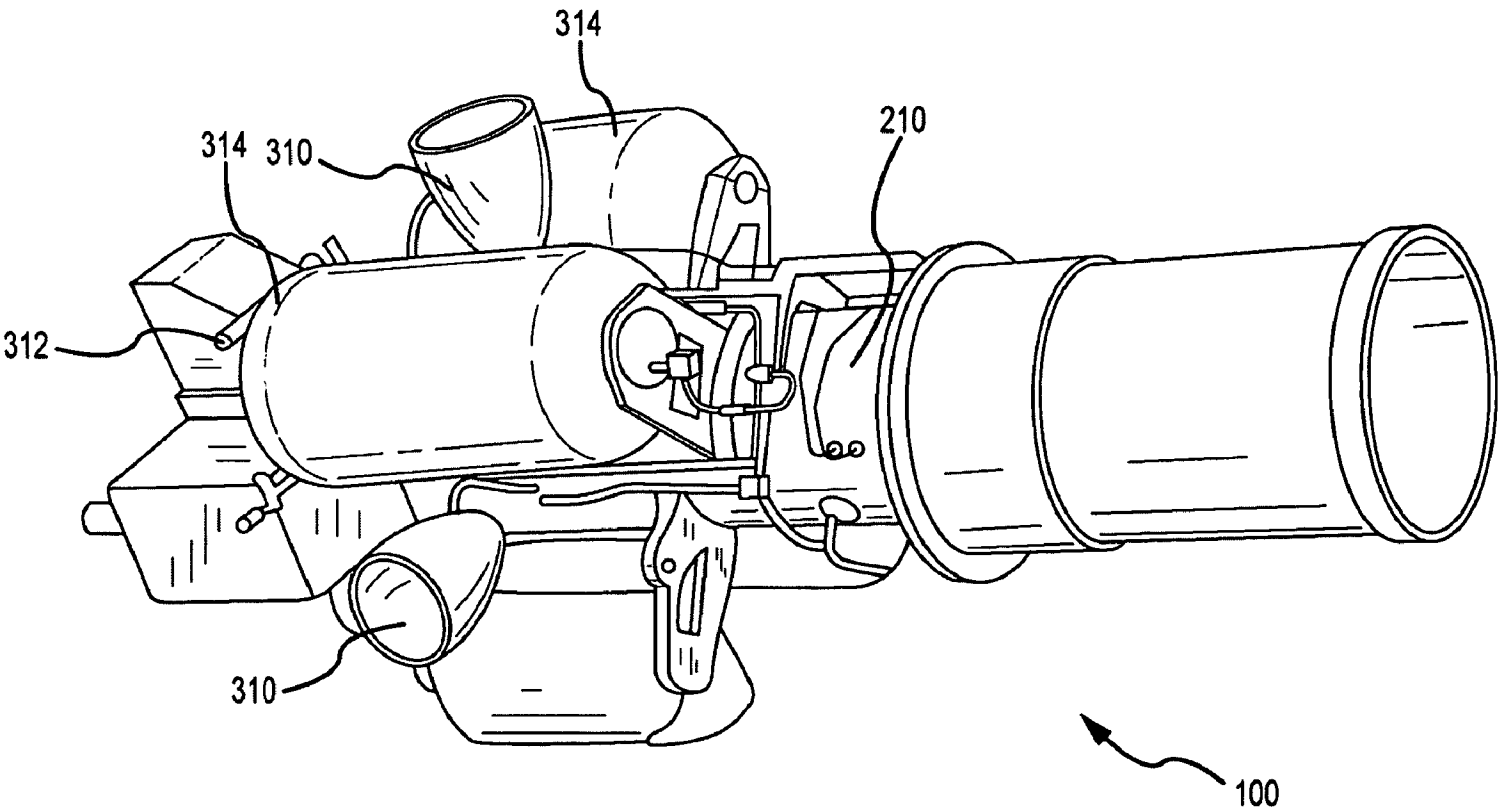
FIG. 3 illustrates a missile comprising a kill vehicle.

In the present embodiment, lateral movement and attitude control are controlled by a divert and attitude control system (DACS) 222. The DACS 222 produces force to guide the missile 100 along its course. Referring to FIG. 3, the DACS 222 may comprise any appropriate elements for guiding the missile 100, such as divert thrusters 310 and attitude control thrusters 312. The divert thrusters 310 produce substantial thrust to effect substantial course changes. In the present embodiment, four divert thrusters 310 comprise four thruster nozzles configured to apply force along two axes. The axes are each orthogonal to the main longitudinal axis of the missile 100.

ACS Thrusters

The attitude control system thrusters 312 may effect a finer degree of control on the missile 100, for example rolling the missile 100 around its main longitudinal axis in either direction and/or making fine course changes in one or more directions orthogonal to the main longitudinal axis of the missile 100. In the present embodiment, the attitude control system thrusters 312 comprise two thrusters situated near the aft portion of the missile 100. The divert thrusters 310 and the attitude control thrusters 312 control the course of the missile 100 as directed by the control system 216.

Containers

The DACS thrusters 310, 312 eject mass to apply force to the missile 100. The mass ejected may comprise any appropriate mass, such as a conventional expanding gas fuel. For example, the mass ejected from the thrusters 310, 312 may comprise a conventional combustible propellant.

In the present embodiment, the fuel and a catalyst, such as an external system 224, as oxygen or other oxidizer for facilitating combustion, are contained in separate containers 314, such as external tanks. The fuel suitably comprises a conventional liquid fuel, and the oxidizer comprises pressurized and/or liquid oxygen or other oxidizer. The containers 314 may comprise any suitable containers for transporting and/or storing the propellant, oxidizer, and/or other materials. In one embodiment, each container includes a shell and a liner. The shell defines a hollow interior chamber and provides the structure for the container. The liner inhibits leakage from the container 314. The containers 314 may be detachable from the airframe 210, for example to facilitate maintenance and/or replacement of the containers 314.

Shell

In the present embodiment, the shells comprise strong, lightweight material, such as a resin/fiber laminate composite. Alternatively, the shells may comprise metal, ceramic, polymer, or other appropriate material, for example according to the environment and functions of the container. In addition, the shells may be formed in any suitable manner, such as according to conventional manufacturing techniques, including resin transfer molding, filament winding, and/or tape placement techniques. The shell may also take any appropriate shape and size, for example according to the anticipated fuel capacity requirement, space and weight allowances, and other relevant considerations.

Each shell defines an interior chamber. The liner is disposed within the interior chamber, and the fluid is disposed within the liner. The liner may comprise any appropriate material and configuration. In the present embodiment, the liner comprises a collapsible bladder disposed within the shell, such as a bladder formed of a thin wall of polymer, aluminum, titanium, or corrosion resistant steel. The liner may be selected and configured according to any appropriate criteria, such as collapsibility and resistance to degradation in response to the fluid within the liner.

Airframe

Figure 4:
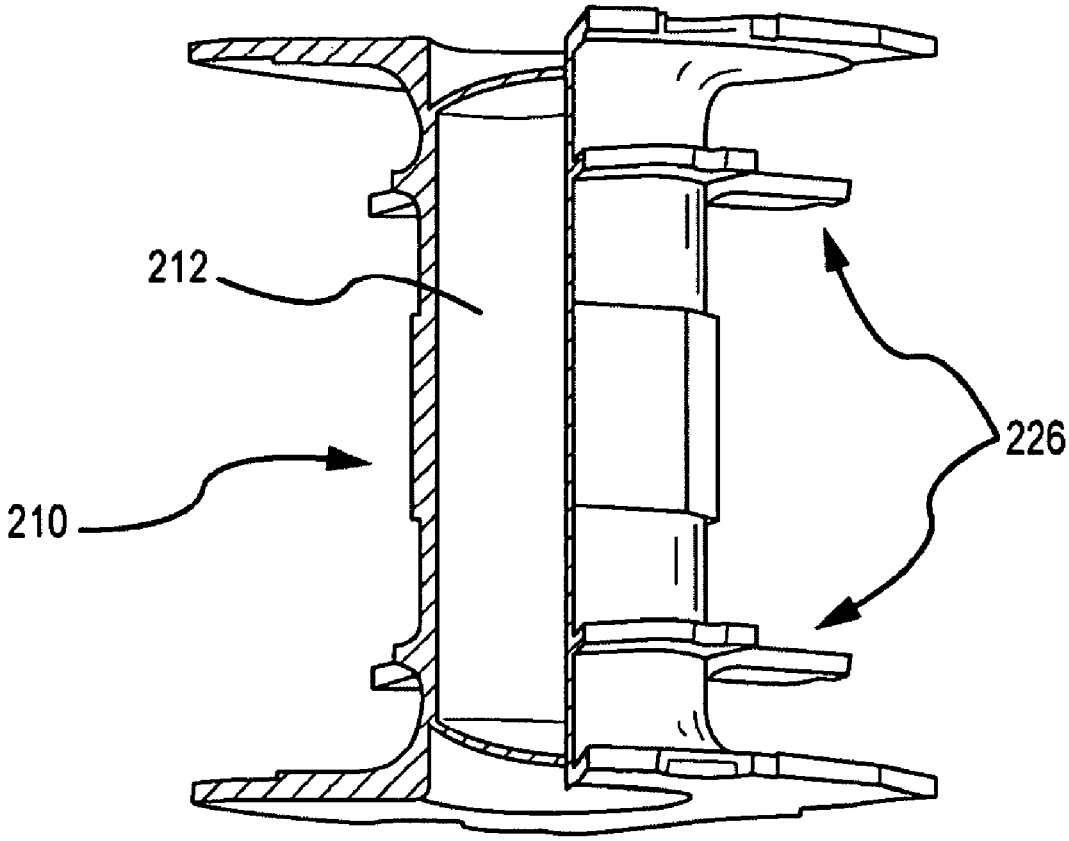
FIG. 4 illustrates an airframe.

The airframe 210 comprises the mechanical structure of the missile 100 on which the propulsion system 218 and the control system 216 are mounted. The airframe 210 may comprise any appropriate structure for the missile 100, such as a conventional missile or kinetic kill airframe. In the present embodiment, the airframe 210 comprises a single composite-material airframe 210 including at least one internal chamber 212, as representatively illustrated in FIG. 4.

The airframe 210 may comprise any appropriate material and configuration. In the present embodiment, the airframe 210 comprises a stiff, lightweight material, such as a resin/fiber laminate composite. In addition, the airframe 210 material may be selected to have low out-gassing and low moisture-absorption characteristics. Further, the airframe 210 material may be selected and the airframe 210 designed for vibration-damping. In the present embodiment, the airframe 210 material and design exhibit a stiffness at least double the first and second natural frequencies of the overall missile 100.

Any appropriate manufacturing technique may be used to produce such a composite, such as utilizing standard laminate manufacturing techniques including resin transfer molding, filament winding, and/or tape placement techniques. Likewise, any suitable materials may be used for the resin and the fibers in such a structure. For instance the resin may comprise cyanate ester, epoxy, unsaturated polyester, vinyl ester, polyurethane, acrylic, phenolic, silicone, polyimide, polyamide, bismaleimide, or any other possible resin. The fibers may be arranged in any appropriate pattern such as random, unidirectional, woven, matted, knitted, stitched, braided, or veiled. The fiber may also comprise any suitable fiber material, such as carbon, aramid, or boron. Further, the airframe 210 may utilize particle reinforcement other than fibers, such as spherical or semispherical particles. Alternatively, the airframe 210 may comprise other materials, such as metals, ceramic, polymers, or other appropriate materials.

The airframe 210 includes at least one internal chamber 212, a mounting system 226 for the containers 314, and a fluid transfer system 228. The internal chamber 212 houses a material for operation of the missile 100, such as control systems, fuel, oxidizer, coolant, or pressurant. The mounting system 226 facilitates connection of the containers 314, directly or indirectly, to the airframe 210, and the fluid transfer system 228 transfers fluids between the containers 314 and the other elements of the missile 100. For example, the internal chamber 212 may contain a pressurizing fluid, which may be provided to one or more of the containers 314 via the fluid transfer system 228 to promote expulsion of the container 314 contents.

Figure 5:
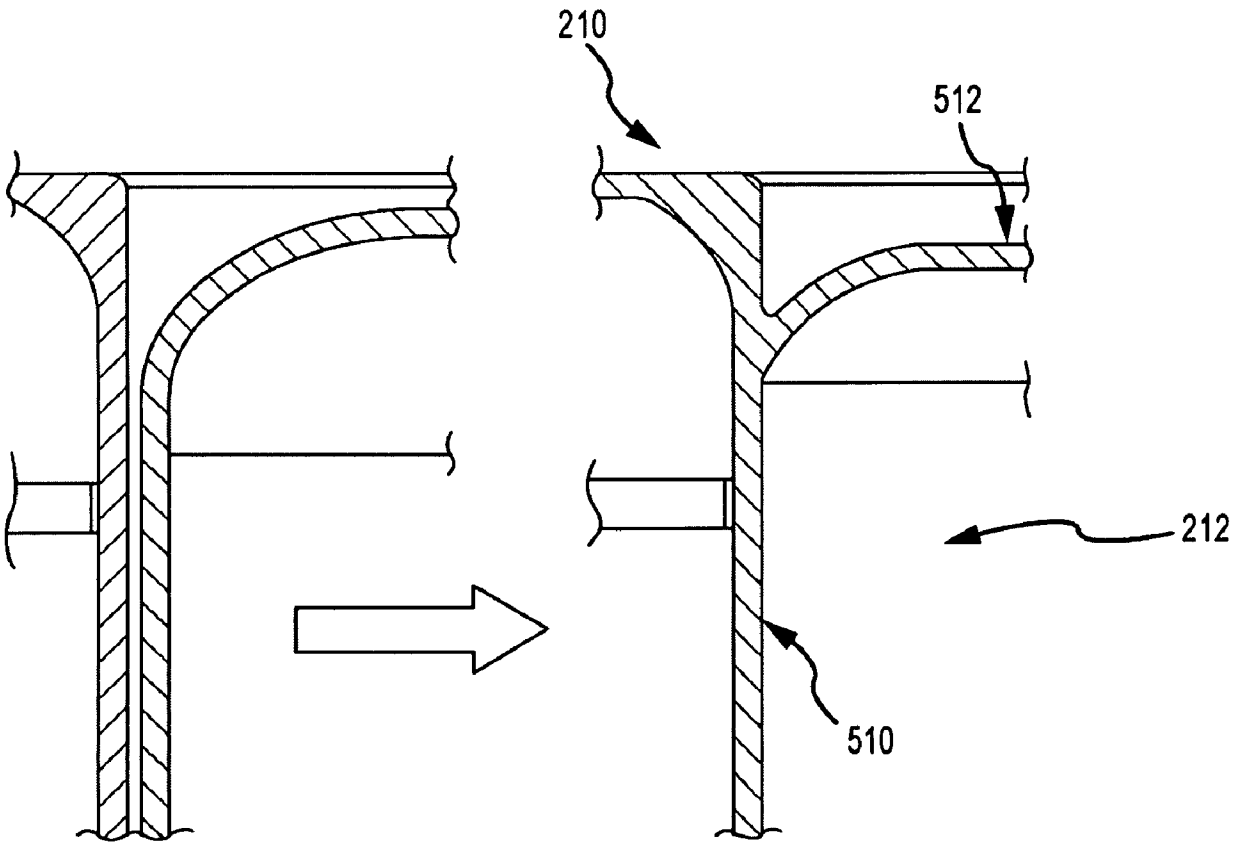
FIG. 5 illustrates a cross-section of a portion of an airframe.

In one embodiment, the internal chamber 212 is integrated into the airframe 210. For example, the internal chamber 212 may be defined by an interior surface of the airframe 210. The internal chamber 212 may have any appropriate shape. Referring to FIG. 5, in the present embodiment, the internal chamber 212 is defined by an approximately cylindrical interior surface 510 and two approximately domed or flat endcaps 512. The cylindrical interior surface 510 may be the interior surface of a single wall that separates the internal chamber 212 from the external environment outside the missile 100. The internal chamber 212 is inseparable from the airframe 210, which may reduce the mass requirements for the airframe 210 and eliminate connection structure necessary for a separable tank. The integrated internal chamber 212 may also enhance reliability and manufacturability, reduce parts count, reduce the cost of the missile 100, and/or reduce oscillations. The integrated internal chamber 212 may further increase the stiffness of the airframe 210, improving the performance of the missile 100, as well as reducing the deflection of the DACS 222 when activated, such as deflection of the ACS thrusters 312 when firing, thus further reducing unwanted oscillations.

The internal chamber 212 may contain any appropriate materials for the application and/or environment. In the present embodiment, the internal chamber 212 is configured to contain a pressurized fluid, such as air, helium, or nitrogen, for pressurizing the containers 314. The internal chamber 212 may contain, however, any suitable materials or elements, and may be configured accordingly. For example, to contain a pressurized gas, the internal chamber 212 may be sealable. The internal chamber 212 may also be accessible, for example via a valve to drain or fill the internal chamber 212.

The internal chamber 212 may further contain a liner to inhibit unintended leakage of the fluid from the internal chamber 212 and/or protect the interior wall 510 of the airframe 210. The liner may comprise any appropriate material, shape, and/or thickness. In the present embodiment, a thin metallic liner approximately five thousandths of an inch thick is disposed within the internal chamber to prevent unintended leakage of compressed helium or other fluid. In alternative embodiments, the internal chamber 212 does not contain a liner, and the internal chamber 212 may be adequately sealed to inhibit unintended leakage of the fluid.

The fluid transfer system 228 permits transfer of fluid between the internal chamber 212 and at least one of the containers 314. In the present embodiment, the fluid transfer system 228 facilitates transferring pressurized gas from the internal chamber 212 to the exterior of the container 314 liner, which tends to collapse the volume of the liner within the container 314. The fluid transfer system 228 may comprise any appropriate system for transferring the relevant material between the internal chamber 212 and at least one of the containers 314, such as hoses, pipes, tubes, conduits, passageways, channels, chambers, tunnels, and valves.

The mounting system 226 facilitates attaching the containers 314 to the airframe 210. The mounting system 226 may comprise any appropriate elements for attaching the containers 314 to the airframe 210, such as alignment pins, bolts, coupling points, mounting brackets, bands, connectors, clamps, adapters, couplings, fasteners, joints, junctions, bonds, links, ties, and the like. In various embodiments, the mounting system 226 may be omitted, for example in missiles 100 in which the containers 314 are integrated into the airframe 210. In the present embodiment, the mounting system 226 comprises brackets or supports which extend out from the airframe 210 and fasten to the containers 314.

MKV Embodiment

Figure 6:
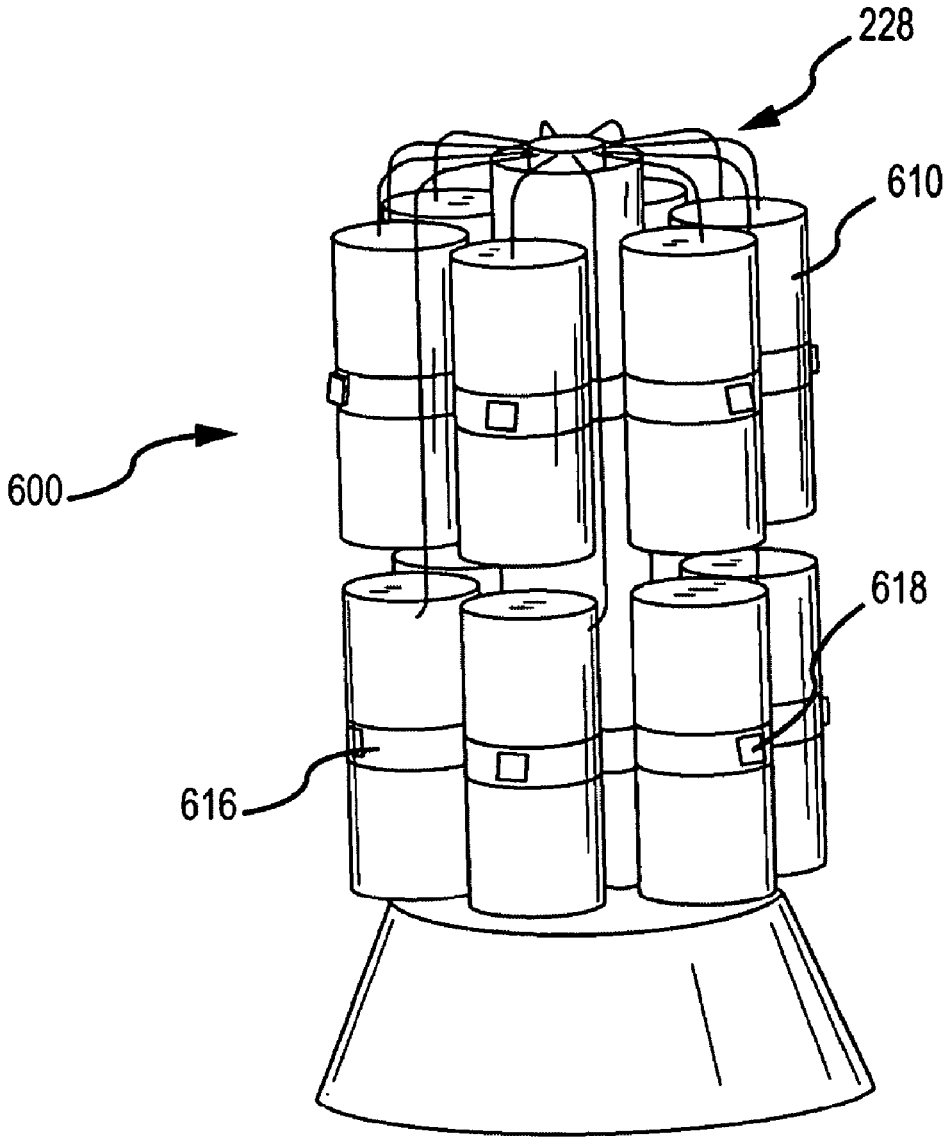
FIG. 6 illustrates a carrier stage of a missile.

The missile 100 and airframe 210 may further comprise any appropriate elements and systems, such as propulsion brackets, thrust pads, connection points for boosters and nose cones, communications antennae, and the like. In addition, the airframe 210 and/or missile 100 may be adapted for other environments and/or missions. For example, referring to FIGS. 6 and 7, various aspects of the present invention may be implemented in conjunction with a missile requiring coolant, such as a carrier stage for a multiple-kill-vehicle (MKV) missile utilizing coolant to cool infrared sensors for multiple kill vehicles (KVs). In this embodiment, the missile includes a final carrier stage 600 that may be connected to one or more booster stages. The carrier stage 600 carries the KVs 610 until the KVs 610 are released to intercept their respective targets.

KVs

The KVs 610 may comprise any suitable systems attached to the carrier stage 600. In alternative embodiments, the KVs 610 or containers 314 may be replaced by other systems, such as sensors, communication systems, or other elements. In the present embodiment, the KVs 610 comprise kinetic kill interceptors to be released from the carrier stage 600 to independently target and destroy targets, such as incoming missiles, aircraft, or satellites. Each KV 610 may include one or more infrared sensors, such as for tracking potential targets. The infrared sensors may be cooled using the coolant to reduce interference. To preserve coolant, the coolant may not be released until immediately before the sensors are activated. The coolant is stored aboard the carrier stage 600 prior to release to the sensors.

Carrier Stage

The carrier stage 600 carries the KVs 610 to the point of deployment. The carrier stage 600 may comprise any appropriate structure and elements, such as a conventional final stage booster rocket or other transport system. The carrier stage 600 may include an airframe 612 having an integrated internal chamber 614. In the present embodiment, the internal chamber 614 is formed at the fore end of the airframe 612 as a cylinder around which the KVs 610 are mounted. The coolant is stored in the internal chamber 614. The carrier stage 600 may also include additional equipment or systems, such as a propellant or pump for delivering the coolant to the sensors via the fluid transfer system 228.

The mounting system 226 may also be adapted to the MKV missile. For example, referring now to FIG. 6, the KVs 610 may be attached to the airframe 612 by belly bands 616. The KVs 610 may be selectively released, for example by pyro-release devices 618, to intercept their respective targets. Likewise, the fluid transfer system 228 may be adapted to selectively provide the coolant to the individual KVs 610, such as via one or more valves and hoses. The control system 216 may control the fluid transfer system 228 to release the coolant to the KVs 610 immediately prior to activation and exposure of the sensors to begin tracking targets.

Operation

Figure 8:
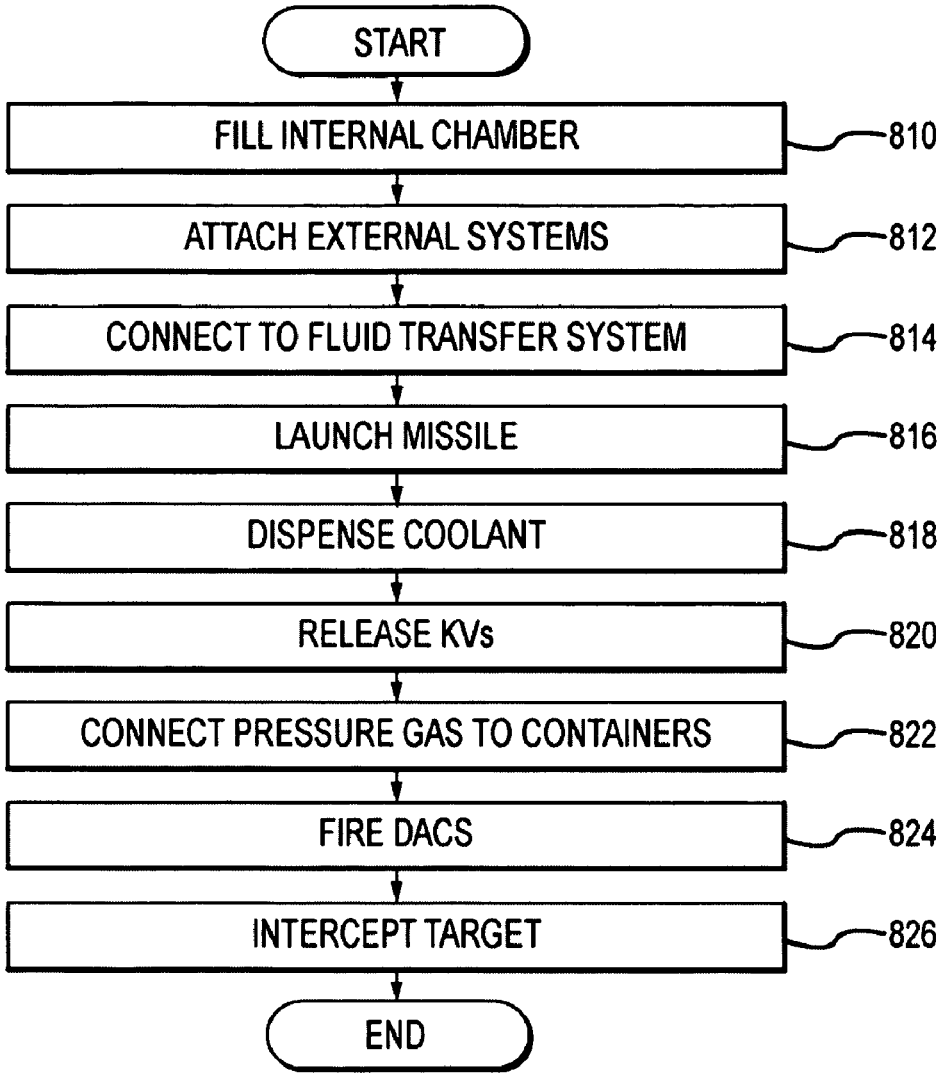
FIG. 8 is a flow chart illustrating operation of a missile having multiple kill vehicles.

In operation, the missile 100 facilitates selectively dispensing a fluid. For example, referring to FIG. 8, the internal chamber 212 of the missile 100 may be filled with a fluid, such as a pressurized fluid. The fluid may be released by the fluid transfer system 228 at a selected time. For example, the fluid may be released before activation of the sensors to cool the sensors. Alternatively, the fluid may be released from the internal chamber 212 and transferred to the container 314 to pressurize the container 314 contents.

For example, a fluid, such as a coolant or a pressurized gas like helium or nitrogen, may be disposed within the internal chamber 212, 614 of the airframe 210, 612 (810). In embodiments including external systems, the external systems may be attached to the missile 100 (812). For example, containers 314 may be attached to the missile 100 via the mounting system 226, and/or the KVs 610 may be attached to the airframe 612. The containers 314 may store fuel, oxidizers, or other materials, and may contain liners, for example to inhibit leakage and facilitate pressurization. The internal chamber 212, 614 and other systems, such as the containers 314 and/or the KVs 610, may be connected to the fluid transfer system 228 (814). The missile 100 may be otherwise prepared for launch, such as attaching boosters or mounting the missile 100 on a launcher.

Figure 7:
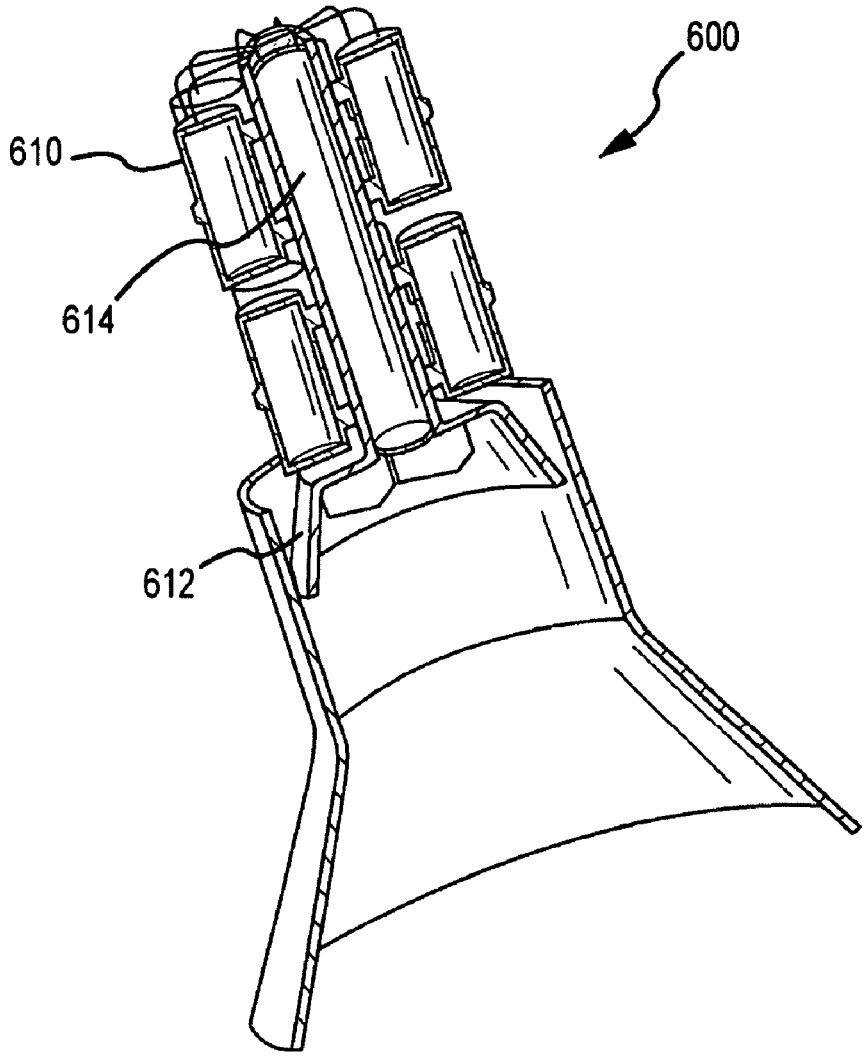
FIG. 7 illustrates a cross-section of the carrier stage.

The missile 100 may be launched, for example to attack or monitor a target (816). In one embodiment, one or more boosters propel the missile 100 on a trajectory to reach the target. Referring now to FIG. 7, the carrier stage 600 approaches a point where the KVs 610 are to activate, at which time the control system 216 activates the coolant fluid transfer system 228, which transfers coolant from the coolant internal chamber 614 to the sensors (818). When the sensors are activated, the coolant has cooled the sensors for optimal operation. The carrier stage 600 then releases the KVs 610 (820), and the KVs 610 independently proceed to intercept their respective targets.

Each of the KVs 610 may comprise the missile 100 as shown and described in conjunction with FIG. 3. In this embodiment, the sensors of each KV 610 identify a relevant target and the control system 216 guides the KV 610 to intercept it. To control the position and attitude of the KV 610, the control system 216 fires the divert thrusters 310 and/or the attitude control thrusters 312.

To provide the fuel and oxidizer to the DACS 222, the fluid transfer system 228 connects the internal chamber 212 to the containers 314 (822), for example using a valve controlled by the control system 216. In one embodiment, the fluid transfer system 228 delivers the pressurized gas to the interior of the shell and the exterior of the liner. The pressurized gas tends to collapse the flexible liner, forcing the fuel, oxidizer, or other contents of the liner out of the liner to the DACS 222. The DACS 222 may then combust the fuel and oxidizers to generate thrust (824). As the fuel and oxidizer are used, the pressurized gas from internal chamber 212 collapses the liners to maximize fuel and oxidizer use. In addition, as the missile 100 experiences shocks and vibrations, such as due to the DACS 222 firing or atmospheric effects, the stiff airframe 210 dampens oscillations, inhibits oscillations at the natural frequency of the missile 100, and reduces deflection of force-bearing elements, such as mounting brackets and thruster pads. The reduced vibrations may promote target tracking and improve missile vehicle guidance. The KV 610 thus guides itself to and intercepts the target (826).

Closing

In the foregoing specification, the invention has been described with reference to specific exemplary embodiments. Various modifications and changes may be made, however, without departing from the scope of the present invention as set forth in the claims The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A missile having an external system, comprising:

an airframe having an interior surface of the airframe defining a substantially enclosed internal chamber configured to enclose a pressurized fluid;

a fluid transfer system connecting the internal chamber to the external system to thereby selectively deliver the pressurized fluid to the external system; and a container defining an interior chamber and a liner, wherein the fluid transfer system is coupled to the external system to deliver the pressurized fluid to a portion of the interior chamber of the container that lies outside of the liner.

2. A missile according to claim 1, further comprising an attitude control system mounted on the airframe, wherein the external system provides fuel to the attitude control system.

3. A missile according to claim 2, wherein the attitude control system operates on liquid fuel.

4. A missile according to claim 1, wherein the airframe further comprises a mounting system configured to engage the external system.

5. A missile according to claim 1, wherein airframe comprises a composite material.

6. A missile according to claim 1, wherein the airframe comprises:

a cylindrical wall defining an exterior surface and at least a portion of the interior surface; and a first end cap and a second end cap, wherein the first and second end caps define at least a portion of the interior surface.

7. A missile according to claim 1, wherein the pressurized fluid is a pressurized gas.

8. A missile according to claim 1, wherein the pressurized fluid is a coolant.

9. The missile of claim 1 wherein the liner is a collapsible bladder containing a fluid, and wherein the missile further comprises a control system configured to selectively deliver the pressurized fluid to the portion of the interior chamber that lies outside of the collapsible bladder to thereby collapse the bladder and thereby expel the fluid from the collapsible bladder.

10. A missile system attachable to an external fuel tank having an interior and an internal liner containing fuel, comprising:

a control system configured to receive fuel from the fuel tank an airframe, comprising:

a mounting system configured to attach to the fuel tank; and an interior surface defining a substantially enclosed internal pressurizing fluid chamber;

wherein the control system is attached to the airframe;

a fluid transfer system selectively connecting the internal pressurizing fluid chamber to the interior of the fuel tank and outside the internal liner.

11. A missile system according to claim 10, wherein the control system operates on liquid fuel.

12. A missile system according to claim 10, wherein the airframe comprises a composite material.

13. A missile system according to claim 10, wherein the airframe comprises:

a cylindrical wall defining an exterior surface and at least a portion of the interior surface; and a first end cap and a second end cap, wherein the first and second end caps define at least a portion of the interior surface.

14. A missile system according to claim 10, wherein the fluid transfer system transfers pressurized gas to the external fuel tank.

15. A missile system according to claim 10, wherein the fluid transfer system transfers coolant to the external fuel tank.

16. The missile system of claim 10, wherein the control system is a divert and attitude control system comprising a divert thruster and an attitude control thruster, and wherein the divert thruster and the attitude control thruster are attached to the airframe.

17. A method of dispensing a fluid in a missile, comprising:

providing a missile airframe comprising an interior surface defining a substantially enclosed internal chamber;

disposing a pressurized fluid into the internal chamber;

providing a container attached to the airframe;

disposing a liner within the container;

disposing the fluid to be dispensed within the liner; and selectively connecting the internal chamber to the container, wherein connecting the internal chamber to the container comprises transferring the pressurized fluid within the container and outside the liner.

18. A method according to claim 17, further comprising:

disposing a fuel within the liner;

transferring fuel to an attitude control system; and activating the attitude control system using the fuel.

19. A method according to claim 18, wherein the attitude control system operates on liquid fuel.

20. A method according to claim 17, wherein airframe comprises a composite material.

21. A method according to claim 17, wherein the airframe comprises:

a cylindrical wall defining an exterior surface and at least a portion of the interior surface; and a first end cap and a second end cap, wherein the first and second end caps define at least a portion of the interior surface.

* * * * *